United States Patent [19]

Rieke et al.

[11] 4,320,861

[45] Mar. 23, 1982

[54] MOLDED PLASTIC TAMPER-PROOF CAP WITH PULL RING AND TEARABLE MEMBRANES

[75] Inventors: Mahlon E. Rieke, Auburn; Kenneth L. Summers, Angola, both of Ind.

[73] Assignee: Rieke Corporation, Auburn, Ind.

[21] Appl. No.: 148,768

[22] Filed: May 12, 1980

[51] Int. Cl.[3] ..... B65D 47/10

[52] U.S. Cl. ..... 222/541; 215/249

[58] Field of Search ..... 222/527, 529, 531, 532, 222/537, 538, 541; 220/85 SP, 270; 215/249, 254, 255

[56] References Cited

U.S. PATENT DOCUMENTS

| | | | |
|---|---|---|---|
| 2,561,596 | 7/1951 | Rieke | 222/527 |
| 2,565,699 | 8/1951 | Rieke | 222/529 |
| 2,661,128 | 12/1953 | Rieke | 222/529 |
| 2,895,654 | 7/1959 | Rieke | 222/529 |
| 3,040,938 | 6/1962 | Smith | 222/478 |
| 3,434,620 | 3/1969 | Laurizio | 222/541 X |
| 3,480,171 | 11/1969 | Rhode | 215/254 X |
| 3,604,740 | 9/1971 | Summers | 220/60 R |
| 3,613,966 | 10/1971 | Summers | 220/85 SP X |
| 3,661,306 | 5/1972 | Kuckens | 222/541 X |
| 3,804,305 | 4/1974 | Rieke | 222/538 |
| 3,888,377 | 6/1975 | Stadler | 215/249 |
| 3,986,631 | 10/1976 | Ostrem | 220/270 |

*Primary Examiner*—Howard N. Goldberg
*Assistant Examiner*—Fred A. Silverberg
*Attorney, Agent, or Firm*—Woodard, Weikart, Emhardt & Naughton

[57] ABSTRACT

A tamper-proof cap for a container closure device for providing a visual indication of any tampering and tampering attempts with the container closure device includes an annular body portion, a pull ring portion detachably joined to the annular body portion, a tear-out strip portion joined to the pull ring portion and a pair of connecting membranes disposed between the tear-out strip portion and the annular body portion. The annular body portion includes an enclosing wall, an inwardly extending lid section joined to a top edge of the enclosing wall, and an outwardly extending lip section joined to a second opposite edge of the enclosing wall. The inwardly extending lid section is annular in shape and defines a center opening. The pull ring portion is detachably joined to the inner edge of this center opening by three reduced-thickness membrane sections which can be easily torn under nominal manual force. The connection between the pull ring portion and the tear-out strip portion remains intact, yet as additional force is applied upwardly and outwardly on the pull ring portion in the direction of this tear-out strip portion, the connecting membranes begin to tear thereby separating the tear-out strip portion from the remainder of the annular body portion. Once this strip portion is completely removed, the annular body portion is severed and it is then able to be manually removed from its secured position beneath the anchor ring which secures the closure device to the container.

5 Claims, 7 Drawing Figures

MOLDED PLASTIC TAMPER-PROOF CAP WITH PULL RING AND TEARABLE MEMBRANES

BACKGROUND OF THE INVENTION

This invention relates in general to closure devices and in particular to tamper-proof cap designs for providing a visual indication of any tampering attempts with the corresponding container.

The evolution of present-day container closure devices of a type similar to that disclosed herein can be traced from as early as the mid-1940's by a review of the developments and improvements which are disclosed in the following chronologically arranged list of patents.

| U.S. Pat. No. | Patentee | Issue Date |
|---|---|---|
| 2,561,596 | Rieke | 7/24/51 |
| 2,565,699 | Rieke | 8/28/51 |
| 2,661,128 | Rieke | 12/01/53 |
| 2,895,654 | Rieke | 7/21/59 |
| 3,040,938 | Smith | 6/26/62 |
| 3,604,740 | Summers | 9/14/71 |
| 3,613,966 | Summers | 10/19/71 |
| 3,804,305 | Rieke | 4/16/74 |

Rieke ('596) discloses a pouring spout which is nestable within a container and is extendable to a pouring orientation and contractable to a nested orientation. The spout is initially disposed in a closed arrangement by an integral portion which must be cut or slit in order to allow the contents to be poured from the container. The outer periphery of the pouring spout is secured to the container opening by means of a clamping ring of light metal which is readily deformed by a hand-operable crimping tool.

Rieke ('699) discloses a flexible, retractable dispensing spout normally nestable within a container and mounted in an opening therein. A junction portion signifies the point of union between the outer cap member, which forms the base of the extended spout, and the inner spout portion. The spout is sealed by a closure portion comprising a seal which is located immediately contiguous to the junction portion. The seal includes an integral pull member which extends upwardly from the seal and is located quite close to the inside surface of the spout portion. Removal of the seal is accomplished by the use of a tool, such as pliers, which have a suitable narrow-nose design in order to be able to grip the pull member without interfering with the inside surface of the spout portion.

Rieke ('128) is a continuation-in-part patent of patents Rieke ('596) and Rieke ('699) and further discloses a tamper- and seal-proof flexible pouring spout. A tamper-indicating seal is disposed over the end of the spout and may include a semi-severed, tear-out portion which must first be removed in order for the tamper-seal indicator to be removed. Alternatively, this tamper-indicating seal may be removed by a prying action. Disposed within the spout opening at the uppermost end is an integral plug which is joined to the inside periphery of the spout by means of an annular weakened junction which must be severed with a knife in order to open the spout.

Rieke ('654) discloses a bail handled closure cap of a character to be internally threaded for screw threading into closing position upon an externally threaded member, such as a container neck, spout or the like. The bail is connected with the cap through opposed and substantially diametrically extending bosses by means of suitable hinged arrangements.

Smith discloses a vented pour spout wherein a venting unit is rigidly secured to the inside surface of a flexible pour spout, of the type disclosed by the prior listed patents. This venting unit permits the entry of air into the container so as to enable a smooth, continuous flow of fluid from the container by way of the pour spout.

Summers ('740) discloses a container closure combination which is anchored into a container opening by means of a boss and circular anchor ring. The container is plastic and the boss includes an upwardly protruding lip which is sandwiched within an inverted U-shaped annular portion of the closure. The anchoring ring is disposed about the annular portion and when crimped together holds the members together. This arrangement precludes any separation or leakage at the closure, thereby overcoming typical cold flow characteristics of those plastics which are usually employed in such arrangements.

Summers ('966) discloses a nestable pouring spout with a wall-supporting cap of the style that includes an elongated skirt portion. This elongated skirt portion extends coaxially with the neck and body portions of the spout to a point near the intersection of these two portions. The space between the neck portion and body portion at this intersection location is large enough to permit easy removal of the cap and is small enough to permit the skirt portion to support the body portion and avoid stress cracking due to unrestrained movement of the body portion in response to internal container pressure.

Rieke ('305) discloses a container closure concept which includes a flanged overseal closure member having a central cap portion, an intermediate portion and a rim portion.

While each of these prior art devices has its own certain improvements and advantages, the structure required to achieve one set of improvements is not necessarily compatible with the structure required to achieve another, different set of improvements. When one aspect or portion of a part is revised in an effort to achieve an added improvement, the revision may alter or adversely influence other, already-achieved improvements and prevent the attainment of both improvements simultaneously.

Of particular interest with each of the foregoing patents is the design and arrangement of any tamper-proof caps. In some instances, tampering or tampering attempts are revealed by a broken seal or diaphragm. In other designs (U.S. Pat. No. Des. 3,040,938, 3,604,740 and 3,613,966), a removable metallic tamper-proof sealing member is used and this must be pried off. Once removed, it cannot be reattached without evidencing its prior removal. In some cases, a suitable tool for removal may not be available and the metallic construction represents a high-cost item in what is intended to be a low-cost product.

SUMMARY OF THE INVENTION

A tamper-proof cap for a container closure device for providing a visual indication of any tampering and tampering attempts with the container closure device includes an annular body portion having an enclosing wall, an inwardly extending lid section joined to a first edge of the enclosing wall and an outwardly extending lip section joined to a second edge of the enclosing wall, a pull ring portion detachably joined to the annular body portion, a tear-out strip portion joined to the pull ring portion and integrally joined as part of the annular body portion and a pair of first tearable connecting membranes integrally disposed between the tear-out strip portion and the annular body portion, the tear-out strip portion being separable from the annular body portion thereby severing the annular body portion.

One object of the present invention is to provide an improved tamper-proof cap for a container closure device.

Related objects and advantages of the present invention will be apparent from the following description.

DESCRIPTION OF THE PREFERRED EMBODIMENT

Figure 1:
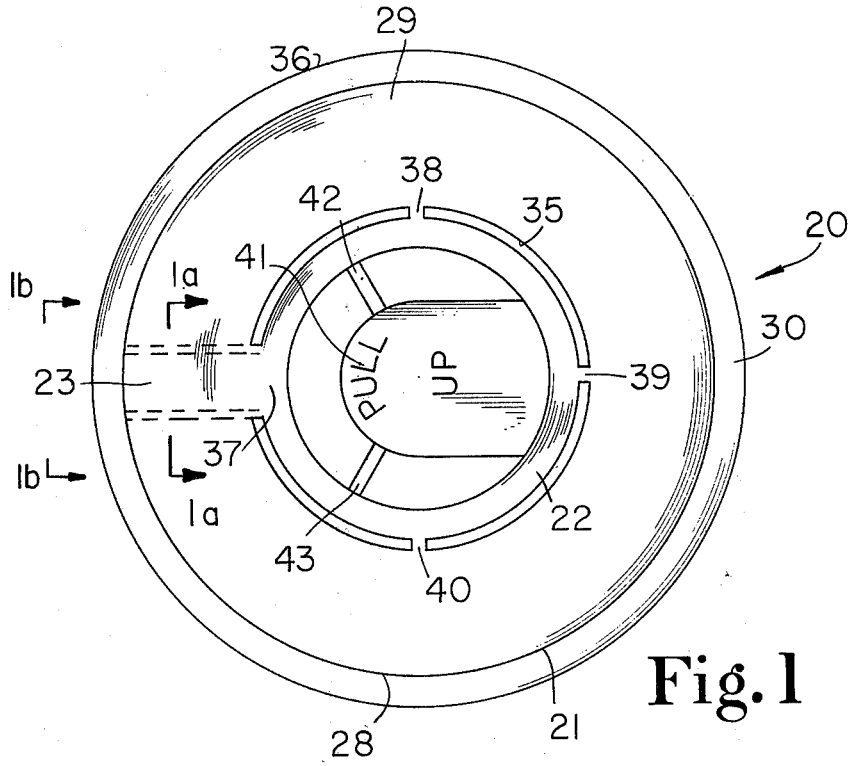
FIG. 1 is an enlarged top plan view of a tamper-proof cap according to a typical embodiment of the present invention.
Figure 1B:
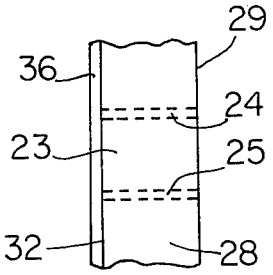
FIG. 1*b* is a side view of the FIG. 1 tamper-proof cap as viewed along line 1*b*—1*b* of FIG. 1 and rotated 90 degrees in a clockwise direction.
Figure 1A:
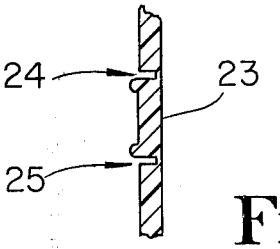
FIG. 1*a* is a detail in full section of a tear-out strip comprising a portion of the FIG. 1 tamper-proof cap as viewed in the direction of arrows 1*a* in FIG. 1 and rotated 90 degrees in a clockwise direction.
Figure 2:
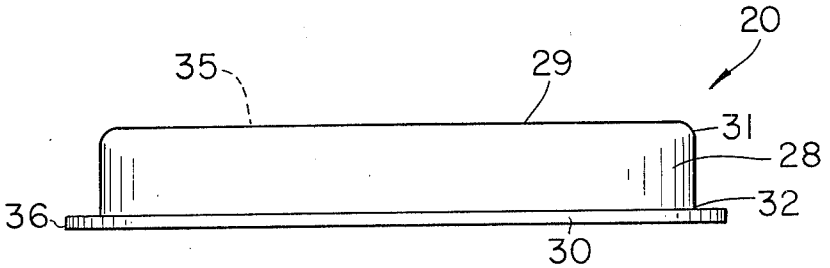
FIG. 2 is a front elevation view of the FIG. 1 tamper-proof cap.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIGS. 1, 1*a*, 1*b* and 2, there is illustrated a tamper-proof cap 20 which includes an annular body portion 21, a pull ring portion 22, a tear-out strip portion 23 and two connecting membranes 24 and 25.

Annular body portion 21 includes a cylindrical enclosing wall 28, an inwardly extending lid section 29 and an outwardly extending lip section 30. Although annular body portion 21 is molded as a single integral member, the enclosing wall can be thought of as having a first or upper edge 31 from which point the lid section extends inwardly and a second or lower edge 32 from which the lip section extends outwardly. The overall annular body portion which is comprised of these three sections can also be thought of as having an inner edge 35 which is circular in shape and an outer edge 36 which coincides with the outermost periphery of lip section 30.

Tear-out strip portion 23 extends from inner edge 35 across lid section 29 (see FIG. 1) and down enclosing wall 28 (see FIG. 1*b*) to lower edge 32 and although integrally a part of annular body portion 21, this tear-out strip portion is detachably joined to the annular body portion by means of connecting membranes 24 and 25. These two connecting membranes are spacing strips of the same material that the remainder of the tamper-proof cap is molded from but are of a substantially reduced thickness (see FIG. 1*a*). When tear-out strip portion 23 is pulled on by a lifting force on pull ring portion 22, one or both of these membranes tear, resulting in a discontinuity of the annular body portion. The discontinuity of the annular body portion permits the annular shape to be distorted and thereby pulled out from beneath the anchor ring. The force applied to the pull ring may actually break through lip section 30, causing the body portion to be severed between edges 35 and 36. The lifting force which may have severed the annular body portion is still required to be applied via the pull ring portion until the cap is pulled free from the anchor ring.

Figure 5:
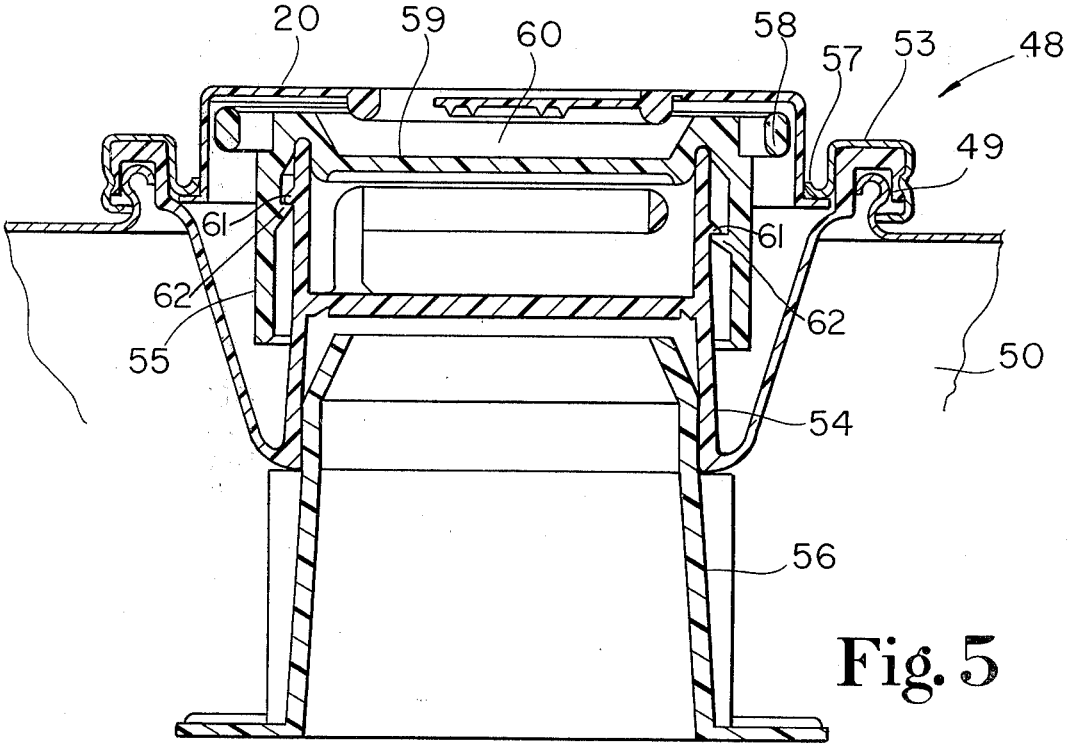
FIG. 5 is a front elevation full section view of a container closure device secured to a container and including the FIG. 1 tamper-proof cap disposed therewith.

The pull ring portion 22 is joined to the tear-out strip portion 23 by connecting tab 37. The pull ring portion is also joined with the annular body portion by means of membrane strips 38, 39 and 40. These membrane strips are also of a significantly reduced overall thickness such that with a moderate degree of force applied upwardly on the pull ring portion, these membrane strips separate thereby allowing the pull ring portion to be used for removal of the tear-out strip portion and for lifting the severed edge out of their retained position. Integrally joined as part of the pull ring portion is a pull tab 41 which is initially maintained in a flush orientation with respect to the pull ring portion by means of membrane strips 42 and 43. Pull tab 41 is joined at its base to the pull ring portion and the free end of the pull tab extends inwardly to the approximate center of cap 20. With all membranes intact, the tamper-proof cap disclosed herein is oriented in its as-received and prior-to-opening configuration. This particular configuration is illustrated in FIGS. 3 and 5 and the specific relationship between various portions is important.

Figure 3:
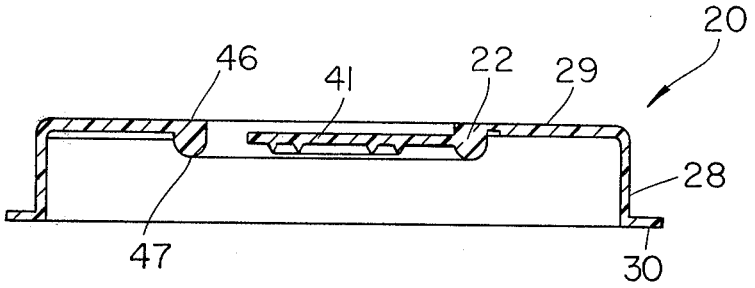
FIG. 3 is a front elevation full section view of the FIG. 1 tamper-proof cap.

Referring to FIG. 3, tamper-proof cap 20 is illustrated in a full section view and the relationship between the pull tab 41, pull ring portion 22 and lid section 29 are clearly illustrated. From this particular figure it is seen that the pull ring portion has a substantially flat upper surface 46 and a rounded lower surface 47 and that the upper surface is substantially flush with the uppermost surface of the lid section. It is also illustrated by this figure that the pull ring portion is approximately twice the thickness of the lid section and that the lid section, the enclosing wall and the lip section are all of substantially the same thickness. A final relationship illustrated by this figure is that the pull tab is joined at the approximate center of the pull ring portion thickness, and due to this thickness, is slightly recessed below the geometric plane defining the upper surface 46 of the pull ring portion and the upper surface of lid section 29.

The flushness of the top surface of this tamper-proof cap is desirable because it both presents a pleasing package appearance and prevents any of the portions which are ultimately to be pulled for removal from being inadvertently hooked or caught on some other object. If, for example, the pull ring portion protruded upwardly, it would be much more susceptible to being caught or hooked on a foreign object and separated from the remainder of the cap at a point in time when such separation is not desired. The plurality of points where membrane strips are employed, assist in maintaining the various portions in this flush orientation as well as providing a connecting path for the molding material thereby enhancing the molding process and assuring a complete fill of liquid molding material to all portions of the cap.

Although the pull tab 41 may be considered as an option, it does benefit the overall construction in that it provides a starting means for the lifting of the pull ring portion for the ultimate severing of the tear-out strip portion from the remainder of the cap. Once the contents of the particular container with which this container closure device and its associated tamper-proof cap are used is desired to be opened, pull tab 41 is pried upwardly on by the finger or fingernail of the user. With a moderate amount of force, the two connecting membrane strips 42 and 43 are broken and then the pull tab may be gripped with the thumb and index finger or by a pair of pliers. Additional upward pulling force on this pull tab results in separation of the pull ring portion from inner edge 35. In lieu of using pull tab 41, it is also possible for the user to insert the index finger beneath the edge of the pull ring portion and directly sever the connecting membranes 38, 39 and 40 thereby freeing the pull ring portion. Regardless of the method, once the pull ring portion is severed from inner edge 35, the finger of the user hooks onto this ring and pulls outwardly toward edge 36 on a line coincident with the centerline of tear-out strip portion 23. As this force is exerted, the two connecting membranes 24 abd 25 are torn longitudinally from inner edge 35 to lower edge 32. Severing through lip section 30 is easily achieved by continued pulling force on the pull ring portion, and this then severs the annular body portion. The upward force exerted to remove portion 23 and sever through lip section 30 lifts the severed edges out of their retained position beneath the edge of the anchor ring 53. As will be explained hereinafter with the description of FIG. 5, severing of the annular body portion by removal of the tear-out strip portion enables this tamper-proof cap to be easily removed from its otherwise secured position atop the container closure device with which this cap is used.

Figure 4:
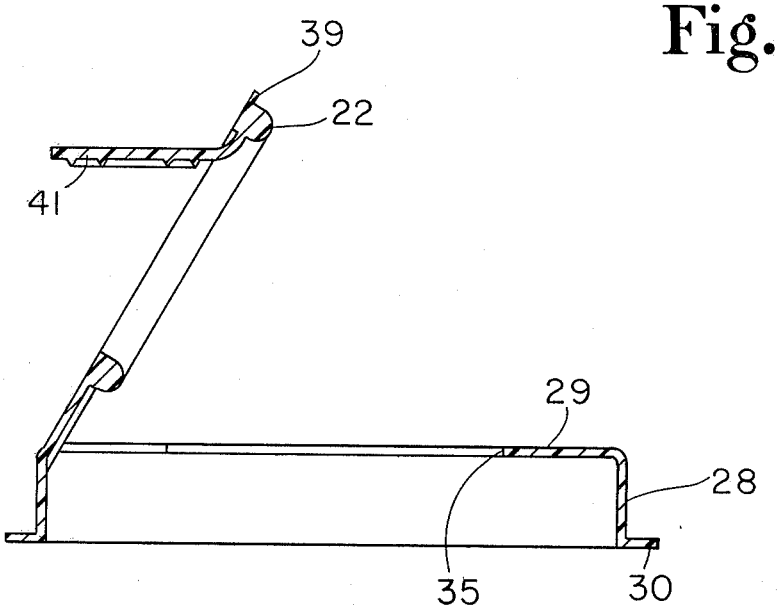
FIG. 4 is a diagrammatic side elevation view of the FIG. 1 tamper-proof cap illustrating the orientation of various portions as the cap is being removed.

The FIG. 4 illustration is a diagrammatic representation of the pull tab 41 being separated from pull ring portion 22 and lifted upwardly on. Also illustrated is the lifting of pull ring portion 22 upwardly and outwardly along the direction of tear-out strip portion 23. As can be seen from this FIG. 4 illustration, there are a variety of ways to grip the pull tab and utilize the pull ring portion for removal of the tear-out strip portion.

Referring to FIG. 5, there is illustrated a container closure device 48 which is secured to a raised annular boss 49 of a corresponding container 50. Container closure device 48 includes an anchor ring 53, flexible spout 54, resealable cap 55 and venting unit 56. As can be seen from the FIG. 5 illustration, anchor ring 53 is arranged for crimping the outer periphery of the flexible spout around the upper edge of the raised annular boss. The inner upturned edge 57 of anchor ring 53 is positioned over lip section 30 of tamper-proof cap 20. Since both of these components are annular in contour, this overlapping arrangement extends throughout the circumference of the tamper-proof cap. It is this overlapping relationship which must be defeated in order for the resealable cap 55 to be removed from the flexible spout 54. For efficient sealing and removal, resealable cap 55 is threadably fitted to flexible spout 54 by means of integral threads 61 and 62. Although flexible spout 54 is illustrated in its nested orientation, it is extendable by upwardly pulling on the bail handles 58. However, tamper-proof cap 20 must first be removed. This removal as has been described is accomplished by removal of the tear-out strip portion so that the annular body portion is severed on one side and the severed edges are lifted up. From this point, it is extremely easy to manually remove the severed cap by pulling around on one severed edge.

Inasmuch as this present design represents a departure from the prior metallic construction for such tamper-proof caps, it is necessary to modify the design of the resealable cap 55. In prior art devices wherein the tamper-proof cap was pried off for removal, the top surface 59 of the resealable cap was substantially flush with the upper most edge of the cap. However, in the illustration of FIG. 5, this top surface is recessed below the top edge thereby allowing a clearance region 60 between top surface 59 and the inside surface of tamper-proof cap 20. This clearance region provides the necessary space for the user's finger to be slipped beneath the pull tab 41 and the pull ring portion 22 in order to lift up on these members and separate the tear-out strip portion from the remainder of the annular body portion.

Although a specific style of tamper-proof cap 20 has been illustrated and described as well as a specific style of container closure device, it is to be understood that the concepts of a flush top surface, a tamper-proof cap which is manually removable without the need for tools to pry, a synthetic material construction rather than the higher-cost metallic construction and a revised resealable cap design for compatibility with the tamper-proof cap are all aspects not heretofore anticipated by any prior art and are both novel and provide significant benefits to this type of container closure device.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A tamper-proof cap for a container closure device for providing a visual indication of any tampering and tampering attempts with said container closure device, said container closure device being of the type having an annular anchor ring for securing the closure device to the container, said tamper-proof cap comprising:

(a) an annular body portion having:
  (1) an enclosing wall,
  (2) an inwardly extending lid section joined to a first edge of said enclosing wall, and
  (3) an outwardly extending lip section joined to a second edge of said enclosing wall;

(b) a pull ring portion detachably joined to the inwardly extending lid section of said annular body portion;

(c) a tear-out strip portion joined to said pull ring portion and integrally joined as part of said annular body portion;

(d) said tear-out strip portion having:
  (1) a first portion extending outwardly across a portion of said inwardly extending lid section of said annular body portion from said pull ring portion to said enclosing wall, and (2) a second portion continuous with said first portion and extending across a portion of said enclosing wall from said inwardly extending lid section to said outwardly extending lip section;

(e) a pair of first tearable connecting membranes integrally disposed between said tear-out strip portion and said annular body portion, said tear-out strip portion being separable from said inwardly extending lid section and from said enclosing wall; and (f) a pull tab member joined to said pull ring portion; and (g) said pull ring portion and said pull tab member each having an uppermost surface which is substantially coplanar with the uppermost surface of said lid section.

2. The tamper-proof cap of claim 1 wherein:

(a) said pull ring is detachably joined to the inwardly extending lid section of said annular body portion by a plurality of second tearable connecting membranes spaced around said pull ring portion, extending outward from said pull ring portion to said inwardly extending lid section;

(b) said pull tab member has a base portion which is integrally joined to said pull ring portion, and said pull tab member has a lifting end which is joined to said pull ring portion by a plurality of third tearable connecting membranes; and (c) said pull tab member is adapted to allow a finger tip to be inserted beneath the lifting end of said pull tab member between said pull tab member and said pull ring portion.

3. The tamper-proof cap of claim 2 wherein said first pair of tearable connecting membranes are substantially parallel to each other.

4. The tamper-proof cap of claim 2 in which said tamper-proof cap is molded as a single, integral, homogenous member from a synthetic material.

5. A tamper-proof cap for a container closure device for providing a visual indication of any tampering and tampering attempts with said container closure device, said container closure device being of the type having an annular anchor ring for securing the closure device to the container, said tamper-proof cap comprising:

(a) an annular body portion having:

(1) an enclosing wall, (2) an inwardly extending lid section joined to a first edge of said enclosing wall, and (3) an outwardly extending lip section joined to a second edge of said enclosing wall;

(b) a pull ring portion detachably joined to the inwardly extending lid section of said annular body portion;

(c) a tear-out strip portion joined to said pull ring portion and integrally joined as part of said annular body portion;

(d) said tear-out strip portion extending across said inwardly extending lid section and down said enclosing wall from said pull ring portion to said outwardly extending lip section;

(e) a pair of tearable connecting membranes integrally disposed between said tear-out strip portion and said annular body portion;

(f) a pull tab member joined to said pull ring portion; and (g) said pull ring portion and said pull tab member each having an uppermost surface which is substantially coplanar with the uppermost surface of said lid section.

* * * * *